United States Patent [19]

Lautenschläger et al.

[11] 4,422,214

[45] Dec. 27, 1983

[54] OVER-CENTER HINGE

[75] Inventors: Karl Lautenschläger; Gerhard Lautenschläger, both of Reinheim, Fed. Rep. of Germany

[73] Assignee: Karl Lauteschläger KG, Reinheim, Fed. Rep. of Germany

[21] Appl. No.: 261,472

[22] Filed: May 7, 1981

[30] Foreign Application Priority Data

May 13, 1980 [DE] Fed. Rep. of Germany ..... 3018184

[51] Int. Cl.[3] ..... E05D 11/10; E05F 1/12

[52] U.S. Cl. ..... 16/291; 16/333; 16/379

[58] Field of Search ..... 16/291, 294, 333, 370, 16/379

[56] References Cited

U.S. PATENT DOCUMENTS 3,195,173 7/1965 McNay et al. ..... 16/291
4,117,569 10/1978 Lautenschlager, Jr. et al. .... 16/291 X

FOREIGN PATENT DOCUMENTS 2016398 1/1973 Fed. Rep. of Germany .
2122857 10/1973 Fed. Rep. of Germany .
2337224 2/1975 Fed. Rep. of Germany ..... 16/291
2401178 7/1975 Fed. Rep. of Germany .
2634558 2/1978 Fed. Rep. of Germany ..... 16/333
1801310 8/1978 Fed. Rep. of Germany .

*Primary Examiner*—Werner H. Schroeder
*Assistant Examiner*—Andrew M. Falik

[57] ABSTRACT

Over-center hinge for a cabinet door, having a supporting-wall-related part which can be fastened to the supporting wall of a cabinet, and a door-related part joined pivotingly to the supporting-wall-related part by a linkage mechanism and constructed as a plug-in cup. In the peripheral wall of the cup a tongue biased toward the interior of the cup by a compression spring is mounted for pivoting over a given angle. On its contour surface projecting slantingly into the interior of the cup a contact surface provided in the area of the linkage end of the supporting-wall-related part, slides during a portion of the opening and closing movement between the hinge closed position and dead center position and urges the door into the closed position. An abutment or catching surface is provided on a detent element which, in the dead-center position, engages the tongue on the one hand and the plug-in cup on the other hand and holds the tongue in the dead-center position, and which is so constructed and arranged that, in the portion of the hinge movement between the dead-center position and the closed position, it is forced out of the tongue holding position to a tongue releasing position.

10 Claims, 9 Drawing Figures

OVER-CENTER HINGE

BACKGROUND OF THE INVENTION

The invention relates to an over-center hinge for cabinet doors, which has a supporting-wall-related part which can be fastened to the supporting wall of a cabinet, and a door-related part articulated by a link mechanism to the supporting-wall-related part and made in the form of a cup for installation in a recess in the door, and having in its peripheral wall adjacent its bottom a tongue. The tongue is mounted for pivoting over a given angular amount under the bias of a compression spring urging it towards the interior of the cup. A contact surface provided at the link end of the supporting-wall-related part slides, during a portion of the opening and closing movement, between the hinge-closed position and a dead-center position along the portion of the profile of the tongue which slopes upwardly towards the cup interior from the bottom thereof, and forces the door into the closed position.

In these known hinges (German Pat. No. 2,016,398 and German Pat. No. 2,122,857), the tongue is given its maximum deflection and its spring its maximum compression by the contact surface of the supporting-wall-related part of the hinge, while, upon the further movement of the contact surface, whether in the closing or opening direction, it performs a movement which slightly relaxes the compression spring. Since this movement is needed in order to urge the tongue against the contact surface with sufficient force to hold the door closed, the compression spring also exerts a force through the tongue, which, when the dead center is passed during the opening movement, imparts to the door mounted with the hinge an acceleration in the direction of opening. In may applications, such an over-center characteristic is not desired, and instead hinges are needed which do exercise a holding force on the door in the immediate vicinity of its closed position, but otherwise permit an effortless movement of the door by hand, especially without any acceleration of the door in the opening direction. Such an over-center characteristic, however, cannot be achieved in the known hinge equipped with the spring-biased tongue pivotingly mounted in the hinge-mounting cup, because the movement of the tongue that is needed for the production of the closing force is necessarily also produced during the opening movement of the door past the dead center, resulting in the undesired opening force. In such cases, in which the production of an opening force is not desired, hinges have heretofore been used which have a mechanism of complex design and therefore high cost of manufacture, in which the controlling of the over-center behavior is accomplished with a control cam cooperating with a spring-biased lever provided, as a rule, with a roller to reduce friction (German OS No. 1,801,310 and OS No. 2,401,178). Since no space is available in the hinge-mounting cup for such a control cam mechanism, it is disposed in the forward end of the supporting-wall-related part of the hinge, and this also increases the amount of space required and the necessary dimensions of the supporting-wall-related part of the hinge.

It is the object of the invention to improve the known over-center hinges provided with a tongue pivoted within the hinge-mounting cup, such that they will have an over-center characteristic in which the over-center effect will occur substantially only in the range between the closed position and the dead-center position of the door, and will be directed exclusively in the closing direction. There will be no application of force in the opening direction past the dead-center position, i.e., the door equipped with such a hinge can be swung without any resistance from the open position to the dead-center position or a point just preceding same, and vice-versa.

SUMMARY OF THE INVENTION

Setting out from an over-center hinge of the kind mentioned in the beginning, this object is accomplished by the invention in that a detent means is provided which at the dead-center position engages the tongue on the one hand and the recess-mounting cup on the other so as to hold the tongue in the dead-center position. The detent means is so constructed and disposed that, within the range of movement of the hinge between the dead-center position and the closed position, the detent means is displaced from the position in which it holds the tongue to a position wherein it releases it. Thus, the tongue can perform its movement only in the range between the dead-center position and the closed position, while its movement in the range between the dead-center position and the open position is blocked by the detent means controlled by the supporting-wall-related part, and thus, too, it cannot apply any force acting in the opening direction. Since the tongue is held in the dead-center position while the door is open, i.e., does not perform any return movement, the number of working cycles to which the spring biasing the tongue is subjected by the opening of a cabinet door followed by its closing is reduced from the two cycles performed in the known over-center hinges to only one. This is beneficial to the life of the over-center mechanism.

BRIEF DESCRIPTION OF THE DRAWING

The invention is further explained in the following description of a number of embodiments given in conjunction with the drawing, wherein.

DETAILED DESCRIPTION OF PREFERRED EMBODIMENTS

In a peferred embodiment of the invention, the detent means has a rocking lever fulcrumed in the area opposite the pivot axis of the tongue, with its free and pointing toward the tongue and terminating in an abutment edge parallel to the tongue pivot axis. The rocking lever is designed so as to be able to be raised from a position in which the abutment edge is below the profile surface of the tongue to a position in which the abutment edge will hold the tongue in the dead-center position. The rocking lever has a catching or gripping means which drivingly engages a portion of the linkage mechanism or of the supporting-wall-related part which enters the cup during the closing movement of the hinge.

In the over-center hinges preferentially involved, the linkage mechanism is formed by two hinge links each pivotingly mounted on the cup at one end and on the supporting-wall-related part at the other in the manner of a four-pivot linkage. In such hinges the design is preferably arranged such that the rocking lever is stamped and pressed from sheet metal with a side member bent upwardly on each side so that together they straddle the hinge links within the cup. The side members are jointed together at their bottom edges by a cross member whose edge confronting the tongue forms the abutment. The resilient catching or gripping means is formed by two projections pre-embossed one from each of the confronting inner faces of the side members, which projections snap over the side edges of the hinge link that is at the bottom of the cup when the hinge is in the closed position. The rocking lever produced by stamping and pressing from sheet metal takes up virtually no additional room within the cup, so that therefore the conventional over-center hinges can be converted to the desired over-center characteristic merely by the addition of the inexpensively made rocking lever. Otherwise the components used in the normal over-center hinges using spring-biased tongues are still usable.

The rocking lever at the same time is preferably mounted on the same pivot pin as the hinge link which is situated on the bottom of the cup when the hinge is in the closed condition, thereby avoiding the necessity of mounting the rocking lever on an additional pivot pin.

The limiting of the rocking movement of the rocking lever such that it can pivot upwardly only as far as the position corresponding to the dead-center position of the tongue is achieved, in a further development of the invention, by forming abutment surfaces within the hinge mounting cup. These can be engaged by the edges of the side members of the rocking lever in the lever position associated with the dead-center position of the tongue. Separate abutments for limiting the movement of the rocking lever in its lowere position, on the other hand, are unnecessary, since the bottom of the cup provides such an abutment.

Figure 1:
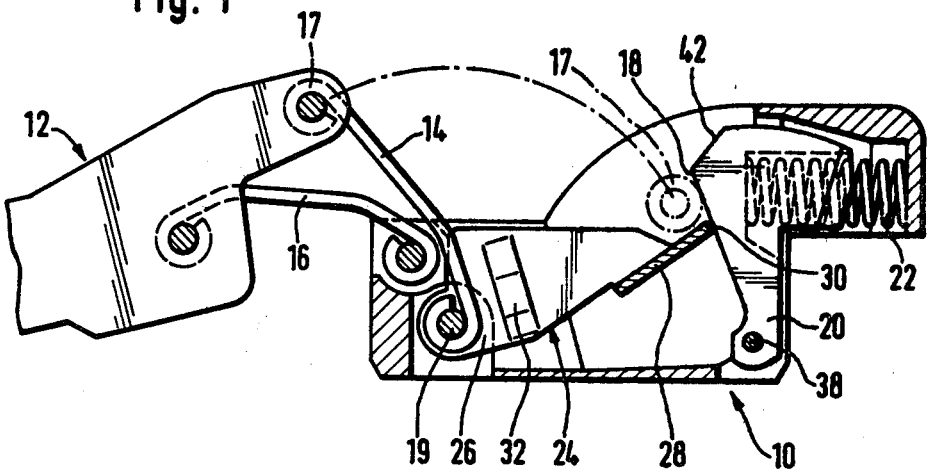
FIGS. 1 and 2 each present a cross-sectional view taken through the hinge-mounting cup of an over-center hinge in accordance with the invention, the front end of the corresponding supporting-wall-related part being shown in the fully open state in FIG. 1, while in FIG. 2 the supporting-wall-related part is represented in the closed state by broken lines.
Figure 2:
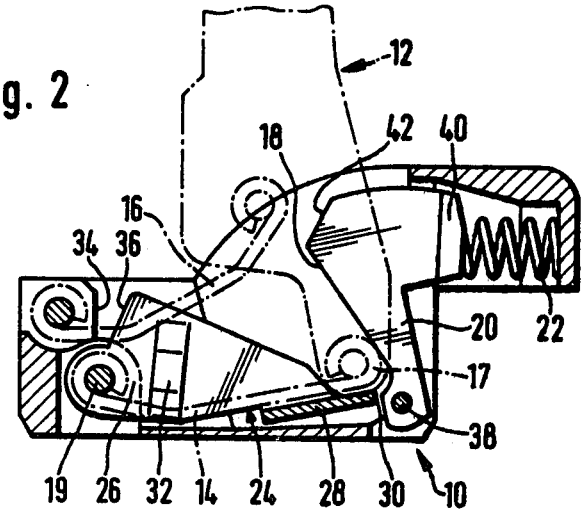
Figure 3:
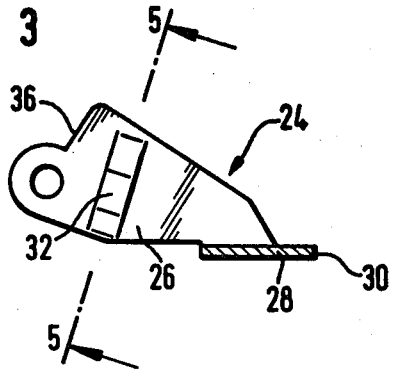
FIG. 3 is a cross-sectional view of the rocking lever provided in the hinge shown in FIGS. 1 and 2 to serve as a detent for holding the tongue, taken along line 3—3 of FIG. 4.
Figure 4:
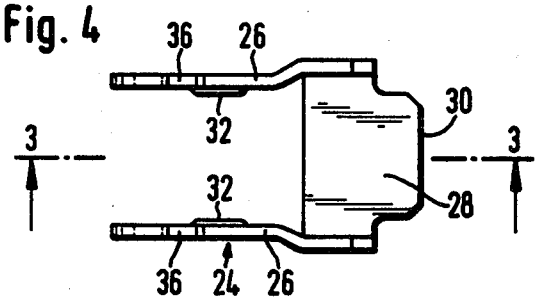
FIG. 4 is a top view of the rocking lever shown in FIG. 3.
Figure 5:
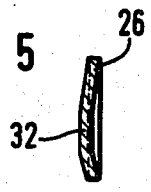
FIG. 5 is a cross-sectional view taken along line 5—5 in FIG. 3.

FIGS. 1 and 2 illustrate the door-related hinge part, in the form of a hinge-mounting cup 10, of an over-center hinge intended for mounting a cabinet door on the supporting wall of a cabinet, FIG. 1 additionally showing a portion of the supporting-wall-related hinge part constructed as an elongated supporting arm 12, and the hinge links 14 and 16 pivotingly mounted on the supporting arm 12 on the one hand and in the hinge-mounting cup 10 on the other. In FIGS. 1 and 2 it can be seen that, when the hinge-mounting cup 10, and with it the corresponding cabinet door, is swung from the open position (FIG. 1) to the closed position (FIG. 2), the eye 17 at the supporting arm end of the hinge link 14 which is closer to the bottom in the closed position will run against a portion 18 of the profile surface of the tongue 20. This tongue is disposed in a cut-out in the wall of the hinge-mounting cup 10 and mounted pivotingly at its bottom end within the cup, and the eye 17 will run against that portion 18 which is inclined inwardly toward the interior of the cup 10, the tongue then being forced by a compression-biased spring 22 into the position represented, in which it is held by a detent means in the form of a lever 24 which will be further described in conjunction with FIGS. 3 to 5. This lever 24, made from sheet metal by stamping and pressing, has two side members 26, one on each side of the hinge link 14, with their edges up, inside of the cup 10. These side members are mounted at their end portion remote from the tongue 20 on a pivot pin 19 on which the hinge link 14 is mounted in the cup 10. They are joined together at their end portion adjacent the tongue 20 by a cross member 28 joining their bottom edges, the cross member's edge 30 confronting the tongue 20, and forming an abutment for the tongue 20, so as to be able to hold the tongue in the position shown in FIG. 1.

This position is precisely the dead-center position, i.e., the position in which the tongue 20 is forced back out of the cup interior to the maximum extent against the bias of the spring 22. In the closing movement, therefore, the eye 17 of the hinge link 14 runs precisely against the profile surface 18 of the tongue as represented by indicating the bearing eye 17 in broken lines in FIG. 1.

The eye 17 forms a contact surface which during part of the movement of the hinge during opening and closing, slides along the profile surface 18 of the tongue. It should be kept in mind that the contact surface does not necessarily have to be formed by the eye 17, but could, for instance, be formed by a surface at the front end of the carcass-related hinge part itself.

As the closing movement continues, the hinge link 14 is pushed against the cross member 28 and drives it towards the bottom of the cup 10. The abutment edge 30 then releases the tongue 20 and the tongue surface 18 is pressed against the eye 17 producing a component of the force stored in spring 22 which acts in the closing direction. That is to say, immediately after the eye 17 runs in the closing direction past the dead center position, up to which it arrives in an unresisting manner, a closing pressure acts on it, causing the hinge to snap into the closed position, and holding it in the closed position under bias (FIG. 2).

In the opening movement, the eye 17 of hinge link 14 slides upwardly on the surface 18 of the tongue and forces it back, compressing the spring 22, until the dead center position is reached. The rocking lever 24, which is resiliently clasped to the hinge link 14, is carried along with the latter, so that the abutment edge 30 holds the tongue 20 in the dead-center position. The resilient clasping of the hinge link 14 to the lever 24 is brought about by projections 32 which are embossed on the inside of the side members 26. These projections 32 resiliently snap over the lateral edges of the hinge link 14. In the dead-center position, the rocking lever 24 has to be released from the hinge link 14, and this is brought about by the fact that abutments 34 are formed within the recess-mounting cup 10 adjacent the pivot points of the hinge links 14 and 16, these abutments 34 being encountered by the edges 36 of the side members 26 when the dead-center position is reached. Since the lever 24 can then turn no further, the hinge link 14 comes free of the projections 32 and the hinge can then be turned all the way open without further application of force by the over-center mechanism.

The tongue 20, which is pivotingly mounted on a pivot pin 38 which passes through aligned bores in the cup 10 and a bore in its own bottom end, is limited in its swinging movement by lateral abutments 40 (FIG. 2) and associated counter-abutments (not shown) in the cup 10. Therefore, it can not be forced by spring 22 all the way into the interior of the cup even when the lever 24 is forced to the bottom of the cup when the hinge is open and the abutment edge 30 is then below the face 18 of tongue 20 and can no longer fix the latter in the dead-center position. In order in this case to make it unnecessary to operate the tongue 20 and the lever 24 by hand so that the lever will again be able to support the tongue in the dead-center position, the tongue is provided on its upper profile with a surface 42 inclined rearwardly from bottom to top, which the eye 17 encounters in the closing of the hinge, forcing the tongue back until the eye then passes over onto the face 18. As soon as the hinge reaches the closed position, the hinge link 14 is again resiliently grasped by the projections 32 in the manner already described, and the over-center mechanism again operates in the above-described manner.

In an alternative embodiment of the invention, the detent means is a latch rotatably mounted on or in the tongue, and having a catching projection which holds the tongue in the dead-center position against an abutment on the cup, and it has a first latch operating arm projecting into the path of the contact surface of the supporting-wall-related part. This arm is displaceable by the contact surface from the projecting position, and is disposed on the latch in such a position that, when the hinge turns from the open to the closed position, the contact surface will engage the arm when the hinge reaches the dead-center position. As the closing movement continues from the dead-center position the contact surface then displaces the first latch operating arm, turns the latch, and thus brings about a disengagement of the catching projection from the abutment on the cup, so that the tongue can then perform the necessary closing movement.

Figure 6:
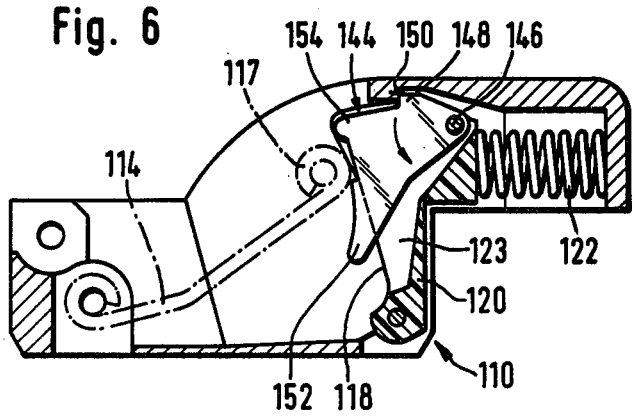
FIG. 6 is a longitudinal central section through the hinge-mounting cup of another embodiment of the over-center hinge of the invention.

The hinge-mounting cup 110 of a second embodiment of an over-center hinge formed in the manner of the invention is shown in FIG. 6. Parts which are identical with the embodiment shown in FIGS. 1 and 2 are provided with the same reference numbers prefixed with a 1, so that only the departures from the embodiment described above are described, whereas it will suffice to refer to the preceding description with regard to the identical parts.

The tongue 120 biased by the spring 122 is shown in the dead-center position. In a vertically disposed, slot-like recess 123 open at the surface 118 and at the top of the tongue, a latch 144 is pivotingly mounted on a pin 146 passing transversely through the tongue 120 in the area of the recess 123. The latch 144 has a catch projection 148 projecting, in the position shown in the figure, from the top of the tongue 120; this catch projection is urged against an abutment surface 150 in the upper portion of cup 110 which forms a cover for the compression spring 122, and thus latches the tongue in the dead-center position. The catch projection 148 can be withdrawn into the recess 123 by turning the latch 144 counterclockwise, whereupon the tongue 120 is released and is able to exercise pressure on the eye 117 of the hinge link 144 to produce a closing force. The turning of the latch 144 is produced by the eye 117 itself which, upon reaching the dead-center position, encounters a first latch operating arm 152 projecting beyond the surface 118 and, as the closing movement continues, forces the latch operating arm 152 back into the recess 123, while at the same time the catch projection 148 comes free of the abutment 150. In this rotation, a second latch operating arm 154, which up to now has been turned back into the recess 123, projects beyond the surface 118 of the tongue 120. When the hinge is swung from the closed position to the open position, the eye 117 sliding back upward then forces the second latch operating arm 154 back to the position without the recess 123, thereby putting the catch projection 148 again against the abutment surface 150 and the tongue is thus held upon reaching the dead-center position. In this moment, the eye 117 is released from the surface 118 and can then be swung all the way to the open position without any influence from the above-described over-center mechanism.

In a further development, in accordance with the invention, of the last-mentioned embodiment, there is provided on the latch a second latch operating arm disposed out of the path of the contact surface when the catching projection is in the position of engagement with the abutment on the cup. This second latch operating arm is so disposed on the catching projection that, upon the displacement of the first latch operating arm it is turned by the contact surface to a position in which it protrudes from the profile of the tongue between the contact surface. This second latch operating arm then assures that, before the door is opened, the catching projection will return to engagement with the cup abutment precisely in the dead-center position and will hold the tongue in the dead-center position.

Figure 7:
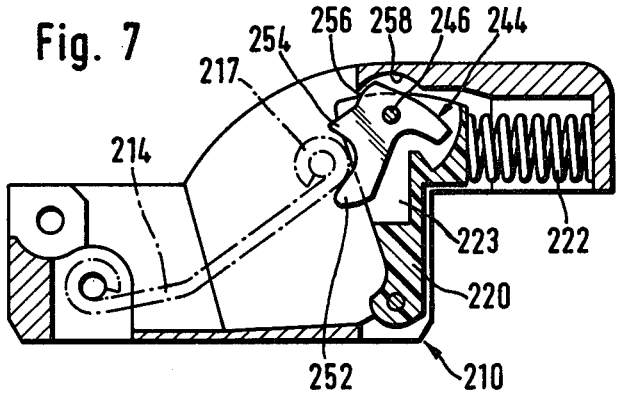
FIG. 7 is a longitudinal central section through a hinge-mounting cup, similar to the hinge-mounting cup shown in FIG. 6, of another embodiment of the invention.

This additional embodiment of an over-center mechanism of the invention is shown in FIG. 7, and again only the differences with respect to the previous embodiments are described. The parts that are the same are again provided with the same reference numbers preceded, however, in this case by the number 2. Again, only the hinge-mounting cup 210 is shown, with the tongue 220 biased by the compression spring 222. A recess 223 in tongue 220 is again provided with a latch 244 which has latch operating arms 252 and 254 cooperating with the eye 217 of the hinge link 214 in the same manner as described above. Instead of the separate catch projection 148 provided in the embodiment in FIG. 6, however, the arcuately curved back 256 of the second latch operating arm cooperates with a matching arcuate recess 258 in the portion of cup 210 which houses the compression spring 222. Otherwise the operation of the latch 244 is the same as that of the latch 144.

Another possibility for the designing of the over-center hinge in accordance with the invention is provided if the detent means is constituted by an abutment projection formed on the upper end of the tongue itself and engaging a counter-abutment on the casing when the tongue is in the dead-center position. The tongue, in addition to its pivotal mounting, is mounted on the cup so as to be displaceable lengthwise by at least an amount allowing the engagement and disengagement of the abutment from the counter-abutment. The holding and releasing of the tongue at the dead-center position in this case is therefore produced by a longitudinal displacement of the tongue when the contact surface of the supporting-wall-related part of the hinge engages with friction the profile of the tongue, shifting it to the held or released position.

Figure 8:
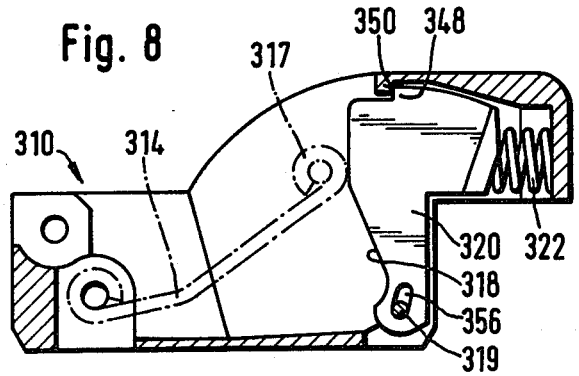
FIG. 8 is a longitudinal central section through a hinge-mounting cup showing an additional embodiment of the invention.

More specifically, in the case of the hinge-mounting cup 310 shown in FIG. 8 of a fourth embodiment of an over-center hinge, the abutment element holding the tongue 320 in the dead-center position is formed by an abutment projection 348 provided at the upper end of tongue 320 itself, this projection being urged, when the tongue 320 is in the dead-center position, against a counter-abutment 350 in the part of the cup 310 which houses the compression spring 322. To bring the abutment projection 348 out of engagement with the counter-abutment 350, the tongue 320 is mounted for longitudinal displacement in the cup 310 in addition to its pivotal mounting. This longitudinal displacement is made possible by providing an elongated hole 356 extending longitudinally of the tongue in the bottom end of the tongue, through which the pivot pin 319 held in bores in the wall of the cup, is passed. The length of the elongated hole 356 is made such as to permit a longitudinal displacement sufficient for the engagement of abutment 348 with the counter-abutment 350. The longitudinal displacement of tongue 320 that is necessary for the latching and unlatching is produced by the friction between the pivot eye 317 and the face 318 of the tongue. If the hinge link 314, represented in broken lines just before it reaches the dead-center position, is swung further in the closing direction, the eye 317 engaging the tongue 320 will carry the tongue 320 downwardly so that, just when it reaches the dead center the abutment projection 348 will come free of the counter-abutment 350. The reverse takes place when the hinge is turned from the closed position to the open position. In addition to the rearward movement of the tongue 320, the eye 317 also lifts the tongue 320 upwardly, in which case the abutment projection 348 will again be caught behind the counter-abutment 350.

Figure 9:
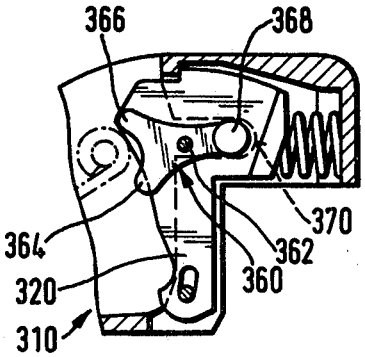
FIG. 9 is a fragmentary cross-sectional view of a further development of the hinge-mounting cup shown in FIG. 8.

By providing a two-armed shifting lever 360 pivotingly mounted on the tongue 320 in the manner represented in FIG. 9, the shifting of the tongue 320 to or from the dead-center locking position can also be performed in a positive manner. The toggle lever 360 pivotingly mounted at 362 on the lateral surface of the tongue 320 terminates at its forward end in two short projections 364, 366, one on which projects beyond the tongue profile surface depending on the position of the lever 360. When the pivot eye 317 of the hinge link 314 slides along the tongue, it is pushed back from its projecting position to a position behind the profile surface, in which case the other projection 366 or 364, as the case may be, is then changed to the projecting position. The other end of the toggle lever 360 is supported by a laterally projecting pin 368 in a slot-like recess 370 in the cup 310. When the lever 360 is rotated by the bearing eye 317, the tongue 320 is therefore positively shifted by the required amount within the elongated hole.

We claim:

1. An over-center hinge for a cabinet door, said hinge comprising: a supporting-wall-related part adapted to be fastened to the supporting wall of a cabinet, a door-related part constructed as a plug-in cup for insertion in a door, a linkage mechanism pivotingly joining the supporting-wall-related part to the door-related part, a tongue mounted in said cup, a compression spring biasing said tongue toward the interior of the cup, said tongue being mounted for pivoting about an axis over a given angle and having a profile surface projecting slantingly into the interior of the cup, a contact surface being provided at the link end of the supporting-wall-related part, said contact surface sliding during a portion of the opening and closing movement of the hinge between the hinge closed position and dead-center position on said profile surface and urging the door into its closed position, an abutment edge being provided on a detent element which, in said dead-center position, engages the tongue on the one hand and the plug-in cup on the other and holds said tongue in the dead-center position, said detent element being constructed and arranged such that, in the portion of the hinge movement between the dead-center position and the closed position, it is forced out of a tongue holding position into a tongue releasing position, said detent element being a rocking lever which is fulcrumed within the plug-in cup in an area opposite the pivot axis of said tongue and which has a free end pointing toward the tongue, and which terminates in said abutment edge disposed parallel to said pivot axis, said rocking lever being constructed for pivoting upwardly in the cup interior from a position wherein the abutment edge is below said profile surface of the tongue to a position in which said abutment edge holds said tongue just in its dead-center position.

2. An over-center hinge according to claim 1, wherein said rocking lever has a catching mechanism for driving engagement with a portion of said linkage mechanism when entering the interior of the cup during the closing movement of the hinge.

3. An over-center hinge according to claim 2, wherein said linkage mechanism comprises two hinge links whose extremities are pivotingly mounted in the manner of a four-joint double linkage in the cup at one end and on the supporting-wall-related hinge part at the other end, said rocking lever being a stamped and pressed piece made of sheet metal and having two side-members situated on edge, one on each side of the hinge links, inside of the cup and joined together at their extremity pointing toward the tongue by a cross-member joining their bottom edges, an edge of said lever facing the tongue forming said abutment edge, said catching mechanism being formed by two projections embossed one from each of the confronting surfaces of the side-members and snapping over the lateral edges of the hinge link which lies at the bottom of the cup in the hinge-closed position.

4. An over-center hinge according to claim 3, wherein said rocking lever is mounted on a fulcrum pin which pivotingly holds also the hinge link which lies at the bottom of the cup in the hinge-closed position.

5. An over-center hinge according to claim 3 or 4, wherein within the cup abutment surfaces are formed which abut against edges of the side-members in the position associated with the dead-center position of the tongue.

6. An over-center hinge for a cabinet door, said hinge comprising: a supporting-wall-related part adapted to be fastened to the supporting wall of a cabinet, a door-related part constructed as a plug-in cup for insertion in a door, a linkage mechanism pivotingly joining the supporting-wall-related part to the plug-in cup, a tongue mounted in said cup, a compression spring biasing said tongue toward the interior of the cup, said tongue being mounted for pivoting about an axis over a given angle and having a profile surface projecting slantingly into the interior of the cup, a contact surface being provided at the link end of the supporting-wall-related part, said contact surface sliding during a portion of the opening and closing movement of the hinge between the hinge closed position and dead-center position on said profile surface and urging the door into its closed position, a detent element being provided which, in said dead-center position, engages the tongue on the one hand and the plug-in cup on the other and holds said tongue in the dead-center position, said detent element being constructed and arranged such that, in the portion of the hinge movement between the dead-center position and the closed position, it is forced out of a tongue holding position into a tongue releasing position, said detent element being a latch rotatably mounted at the tongue, said latch having a catch projection fixing the tongue in the dead-center position at an abutment surface of the cup, and a first latch operating arm projecting in front of the tongue profile surface into the path of the contact surface of the supporting-wall-related hinge part and displaceable by the contact surface from the projecting position, said first latch operating arm being disposed in such a position on the latch that the contact surface of the hinge part comes into engagement with it when the dead-center position is reached in the hinge movement from the open to the closed position.

7. An over-center hinge according to claim 6, wherein a second latch operating arm is provided which is disposed outside of the path of the contact surface of the hinge part when the catch projection is in the position in which it engages an abutment surface of the cup, and which is disposed on the latch such that, when the first latch operating arm is displaced by the contact surface of the hinge part it is swung to a position in which it protrudes from the profile surface of the tongue.

8. An over-center hinge for a cabinet door, said hinge comprising: a supporting-wall-related part adapted to be fastened to the supporting wall of a cabinet, a door-related part constructed as a plug-in cup for insertion in a door, a linkage mechanism pivotingly joining the supporting-wall-related part to the plug-in cup, a tongue mounted in said cup, a compression spring biasing said tongue toward the interior of the cup, said tongue being mounted for pivoting about an axis over a given angle and having a profile surface projecting slantingly into the interior of the cup, a contact surface being provided at the link end of the supporting-wall-related part, said contact surface sliding during a portion of the opening and closing movement of the hinge between the hinge closed position and dead-center position on said profile surface and urging the door into its closed position, a detent element being provided which, in said dead-center position, engages the plug-in cup and holds said tongue in the dead-center position, said detent element being arranged such that, in the portion of the hinge movement between the dead-center position and the closed position, it is forced out of a tongue holding position into a tongue releasing position, said detent element being formed by an abutment projection provided at the end of the tongue remote from the pivot axis and engaging a counter-abutment of the cup when the tongue is in the dead-center position, and the tongue, in addition to its pivotal mounting, being mounted for displacement in the cup in the lengthwise direction of the tongue by at least the engagement dimension of the abutment projection on the counter-abutment.

9. An over-center hinge according to claim 8, wherein a pivot pin mounts said tongue in the cup, said pin being held in bores in a peripheral wall of the cup and passing through an elongated hole in the bottom end of the tongue, the hole extending in the direction of the longitudinal displacement of the tongue.

10. An over-center hinge according to claim 8 or 9, wherein a two-armed toggle lever is pivotingly mounted on said tongue, one lever arm of said lever terminating in two branched projections one of which, depending on the angular position of the toggle lever, projects slightly beyond the tongue profile surface while the other is set in back of the tongue profile surface, the other lever arm being supported in the cup nondisplaceably in the tongue displacing direction.

* * * * *